US009689365B2

(12) United States Patent
Bleyer

(10) Patent No.: US 9,689,365 B2
(45) Date of Patent: Jun. 27, 2017

(54) INTERNAL COMBUSTION ENGINE WITH STARTING AIR SYSTEM

(71) Applicant: Caterpillar Motoren GmbH & Co. KG, Kiel (DE)

(72) Inventor: Benjamin Bleyer, Kiel (DE)

(73) Assignee: Caterpillar Motoren GmbH & Co. KG, Kiel (DE)

( * ) Notice: Subject to any disclaimer, the term of this patent is extended or adjusted under 35 U.S.C. 154(b) by 162 days.

(21) Appl. No.: 14/656,702

(22) Filed: Mar. 12, 2015

(65) Prior Publication Data

US 2015/0267673 A1 Sep. 24, 2015

(30) Foreign Application Priority Data

Mar. 19, 2014 (EP) ..... 14160710

(51) Int. Cl.
*F02B 33/44* (2006.01)
*F02B 33/00* (2006.01)
(Continued)

(52) U.S. Cl.
CPC ..... *F02N 9/04* (2013.01); *F02D 41/0025* (2013.01); *F02D 41/22* (2013.01); *F02N 15/10* (2013.01); *F02N 11/108* (2013.01)

(58) Field of Classification Search
CPC ..... F02N 9/04; F02N 15/10; F02N 11/108; F02D 41/0025; F02D 41/22; F02B 37/04; F02B 21/00
(Continued)

(56) References Cited

U.S. PATENT DOCUMENTS 3,967,132 A * 6/1976 Takamine ..... F02D 17/00 290/30 R
4,213,437 A * 7/1980 Onofrio ..... F02M 1/00 123/179.18
(Continued)

FOREIGN PATENT DOCUMENTS

CN 201714551 1/2011
CN 102261296 11/2011
(Continued)

OTHER PUBLICATIONS

A certified English translation Senbo (Pub. No. JP 63-124828 A), published on May 28, 1988.*
(Continued)

*Primary Examiner* — Thai Ba Trieu

(57) ABSTRACT

An internal combustion engine includes a cylinder for combusting a mixture of fuel and air therein, and a starting air system configured to provide pressurized starting air to the cylinder and to monitor operability of the starting air system. The starting air system may include a pressurized starting air source, a starting air manifold, a starting air venting valve, and a sensing device. The pressurized starting air source is configured to store pressurized starting air. The starting air manifold is fluidly connected to the pressurized starting air source. The starting air venting valve is fluidly connected to the starting air manifold and configured to vent the starting air system. The sensing device is configured to detect a parameter that measures a condition within the starting air system.

17 Claims, 2 Drawing Sheets

(51) Int. Cl.

| | |
|---|---|
| ***F02B 23/00*** | (2006.01) |
| ***F02D 41/06*** | (2006.01) |
| ***F02N 9/04*** | (2006.01) |
| ***F02D 41/00*** | (2006.01) |
| ***F02D 41/22*** | (2006.01) |
| ***F02N 15/10*** | (2006.01) |
| *F02N 11/10* | (2006.01) |

(58) Field of Classification Search
USPC ..... 60/611; 123/179.1, 179.18, 559.1, 585
See application file for complete search history.

(56) References Cited

U.S. PATENT DOCUMENTS

| | | | | |
|---|---|---|---|---|
| 5,205,120 | A * | 4/1993 | Oblander | F02D 41/062 123/585 |
| 8,412,441 | B1 * | 4/2013 | Sturman | F02B 21/00 701/105 |
| 9,096,116 | B2 * | 8/2015 | Reuss | B60K 6/12 123/559.1 |
| 2005/0182553 | A1 * | 8/2005 | Miller | F02B 21/00 701/103 |
| 2006/0052930 | A1 * | 3/2006 | Froloff | F02B 21/00 701/103 |
| 2007/0113803 | A1 * | 5/2007 | Froloff | F02B 21/00 701/103 |
| 2014/0165931 | A1 * | 6/2014 | Pursifull | F02M 35/10229 123/2 |

FOREIGN PATENT DOCUMENTS

| | | | | | |
|---|---|---|---|---|---|
| DE | 19837094 | C1 | * | 2/2000 | F02B 21/00 |
| DE | 19944946 | A1 | * | 3/2001 | F02B 21/00 |
| DE | 10239110 | A1 | * | 3/2004 | F02B 21/00 |
| DE | 10224719 | B4 | * | 3/2007 | F02B 21/00 |
| DE | 102011016993 | | | 3/2012 | |
| DE | WO 2014195345 | A1 | * | 12/2014 | F02B 21/00 |
| EP | 1256714 | | | 11/2002 | |
| ES | EP 1956213 | A1 | * | 8/2008 | F02B 21/00 |
| FR | EP 2687699 | A1 | * | 1/2014 | F02B 21/00 |
| GB | 1563003 | A | * | 3/1980 | F02B 21/00 |
| JP | 62291467 | A | * | 12/1987 | |
| JP | 63124828 | A | * | 5/1988 | |
| JP | 01273830 | A | * | 11/1989 | |
| JP | H10339249 | | | 12/1998 | |
| KR | 20120091658 | | | 8/2012 | |
| KR | 20130127752 | | | 11/2013 | |
| WO | WO 2007/003693 | | | 1/2007 | |
| WO | WO 2013/076357 | | | 5/2013 | |

OTHER PUBLICATIONS

A certified English translation Fischer (Pub. No. DE 102 24 719 B4), published on Mar. 8, 2007.*
A certified English translation Tajima et al. (Pub. No. JP 01-273830 A), published on Nov. 1, 1989.*
European Search Report dated Jul. 28, 2014.

* cited by examiner

INTERNAL COMBUSTION ENGINE WITH STARTING AIR SYSTEM

This application claims the benefit of priority of European Patent Application No. 14160710.1, filed Mar. 19, 2014, which is incorporated herein in its entirety by reference.

TECHNICAL FIELD

The present disclosure generally relates to an internal combustion engine and a method for operating internal combustion engines. Particularly, the present disclosure relates to an internal combustion engine with a starting air system and a method for operating internal combustion engines and monitoring the functionality of the starting air system.

BACKGROUND

Internal combustion engines, such as, for instance, dual fuel internal combustion engines or internal combustion engines running on heavy fuel oil, diesel oil, or gaseous fuel oil, may be used to power any machine or other device, including ships or other marine applications, locomotive applications, on-highway trucks or vehicles, off-highway machines, earth-moving equipment, generators, aerospace applications, pumps, stationary equipment such as power plants, or other engine-powered applications. For accelerating the internal combustion engine, which means for starting the internal combustion engine, it is known to provide pressurized starting air into at least one cylinder of the internal combustion engine via a starting air system including a main starting valve and, for at least one cylinder, a cylinder starting valve providing the starting air to the respective cylinder. The pressure of the starting air causes the pistons to move and, thus, to start rotation of the crankshaft and operation of the internal combustion engine. The main starting valve controls the fluid connection of a pressurized starting air source with the cylinder starting valve(s) via a starting air manifold.

While operating the internal combustion engine, a malfunctioning cylinder starting valve may leak. In such case, for example, at least some amount of the fuel/air mixture supplied to the cylinders for combustion may leak through the malfunctioning cylinder starting valve into the starting air manifold. Hence, the leaked air/fuel mixture may further flow, for instance, through the main starting air valve and may accumulate within, for instance, the engine room where the internal combustion engine is located. In such case, potential explosion danger may be present.

The present disclosure is directed, at least in part, to improving or overcoming one or more aspects of prior systems.

SUMMARY OF THE DISCLOSURE

According to an aspect of the present disclosure, an internal combustion engine may comprise at least one cylinder for combusting a mixture of fuel and air therein, and a starting air system configured to provide pressurized starting air to the at least one cylinder and configured for monitoring the starting air system's operability. The starting air system may include a starting air manifold fluidly connected to a pressurized starting air source configured to store pressurized starting air, a starting air venting valve fluidly connected to the starting air manifold and configured to vent the starting air system, and a sensing device configured to detect a parameter that measures a condition within the starting air system.

According to another aspect of the present disclosure, a method for operating an internal combustion engine is disclosed, wherein the internal combustion engine includes at least one cylinder for combusting a mixture of fuel and air therein, and a starting air system configured to provide pressurized starting air to the at least one cylinder and including at least one cylinder starting valve associated with the at least one cylinder. The method may comprise, during fuel based operation of the internal combustion engine, providing a closed volume in the starting air system upstream of the at least one cylinder starting valve. The method may further comprise detecting a parameter that measures a condition within the closed volume and that deviates from an expected parameter indicating a proper operability of the starting air system, such as the cylinder starting valves, and outputting a signal indicative of leakage of the starting air system.

In some embodiments, the internal combustion engine may further comprise a control unit communicating with the sensing device. The control unit may be configured to output a signal indicating a malfunction of the starting air system, when the detected parameter deviates from a predetermined threshold. For example, the parameter may be a temporal pressure change indicating the pressure change within the closed volume, a methane concentration indicating the methane concentration within the closed volume, and/or a $CO_2$ concentrating indicating the $CO_2$ concentration within the closed volume. In some embodiments, the detected parameter may be a temporal methane concentration change, a temporal $CO_2$ concentration change, and/or a temporal temperature change.

The closed volume may be an isolated volume provided in the starting air system upstream of the cylinder starting valves. For instance, the closed volume may be the volume of, for example, a starting air manifold and/or starting air ducts fluidly connecting the starting air manifold with the cylinder starting valve. Further, as used herein, the parameter indicative of the filling of the starting air system, specifically the closed volume, may relate to a pressure, a methane concentration, a $CO_2$ concentration, and/or a temperature within the starting air system, particularly the closed volume.

In some embodiments, the sensing device may include a pressure sensor configured to measure the pressure within the starting air system, particularly within the closed volume. In yet some embodiments, the sensing device may be a methane sensor configured to measure the methane concentration within the starting air system, particularly within the closed volume, and/or a $CO_2$ sensor configured to measure the $CO_2$ concentration within the starting air system, particularly within the closed volume. In yet some embodiments, the sensing device may include a temperature sensor configured to detect the temperature within the starting air system, particularly within the closed volume.

Other features and aspects of this disclosure will be apparent from the following description and the accompanying drawings.

DETAILED DESCRIPTION

Figure 1:
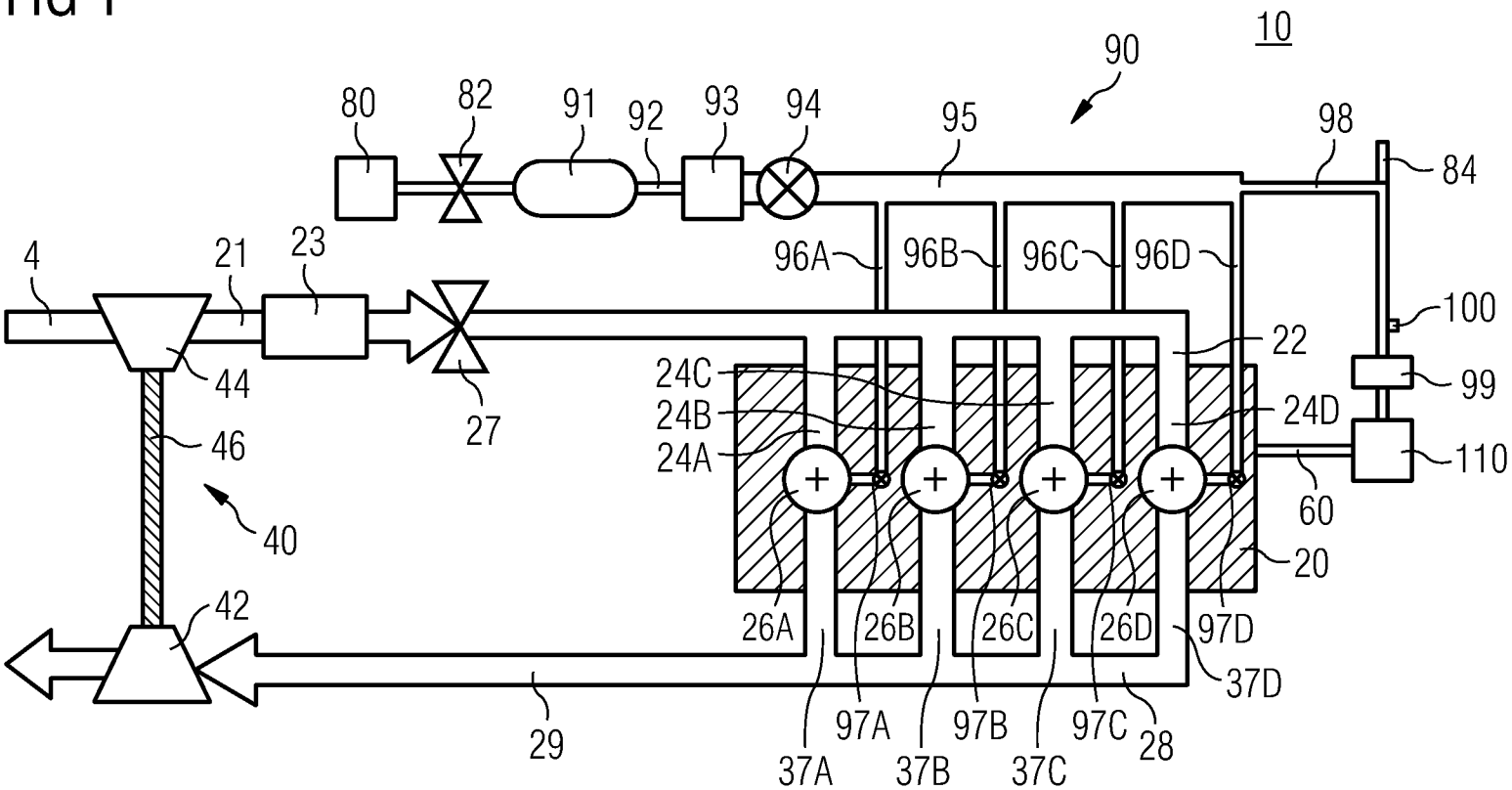
FIG. 1 is schematic view of a turbo-charged internal combustion engine having a starting air system.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

As used herein, the term "starting mode" of the internal combustion engine relates to a condition in which the internal combustion engine is started from zero engine speed to, for instance, a predetermined engine speed, such as, for instance, an ignition engine speed that is sufficient for the internal combustion engine to run on an air/fuel mixture. In some embodiments, the ignition engine speed may be, for example, an engine speed ranging from about 80 rpm to about 120 rpm. During the starting mode, the internal combustion engine is driven by providing pressurized starting air from a starting system to the cylinders. The pressurized starting air moves the pistons for allowing the internal combustion engine to be started.

As also used herein, the term "normal operation mode" of the internal combustion engine relates to a conditions after the internal combustion engine has been accelerated to the predetermined engine speed and runs on fuel. After reaching the predetermined engine speed, supply of the pressurized starting air is interrupted.

The present disclosure may be based at least in part on the realization that monitoring the operability of the starting valves may allow avoiding operating the engine with leaking cylinder starting valves. It was further realized that closing the main starting valve during the normal operation mode of the internal combustion engine and providing a closed volume between the main starting valve and the cylinder starting valves may allow observing the cylinder starting valves. For example, continuously detecting and monitoring the pressure within the starting air system may indicate any leakage of at least one cylinder starting valve. For example, when the detected pressure within the starting air system is out of a predetermined pressure range, a corresponding signal may be output. In some embodiments, the internal combustion engine may, for example, be stopped when the detected pressure within the starting air system is out of a predetermined pressure range, or a warning signal indicating an inoperability of the starting air system or the cylinder starting valves may be output.

In some embodiments, the assessment of the operability of the cylinder starting valves may be based on a detected pressure change during a predetermined period of time. When an inoperability of at least one cylinder starting valve is detected, the control unit may switch the internal combustion engine in, for example, an emergency mode configured to run the engine in low power mode.

In case of a dual fuel internal combustion engine and of a detected leakage of at least one cylinder starting valve during the gaseous fuel mode, the dual fuel internal combustion engine may be switched into the liquid fuel mode. Further, in case of a detected leakage of at least one cylinder starting valve of the dual fuel internal combustion engine during the liquid fuel mode, the dual fuel internal combustion engine may be prevented from switching into the gaseous fuel mode, such that operation of the dual fuel internal combustion engine is maintained in the liquid fuel mode.

The present disclosure may be further based at least in part on the realization that monitoring the operability of the cylinder starting valves and outputting a signal indicative thereof may reduce the risk of accumulation of unburned air/fuel mixture in the engine's environment. Hence, the risk of potential explosions may be reduced.

Referring now to the drawings, an exemplary embodiment of an internal combustion engine 10 is illustrated in FIG. 1. The internal combustion engine 10 may include features not shown, such as fuel systems, air systems, cooling systems, peripheries, drive train components, etc. For the purposes of the present disclosure, the internal combustion engine 10 is configured as a gaseous fuel internal combustion engine running on gaseous fuel, such as, for example, natural gas. One skilled in the art will recognize, however, that the internal combustion engine 10 may be any type of internal combustion engine, for example, a dual fuel internal combustion engine or any other Otto or diesel fuel internal combustion engine that utilizes a mixture of fuel and air for combustion.

The internal combustion engine 10 may be of any size, with any number of cylinders and in any configuration ("V", "in-line", etc.). The internal combustion engine 10 may be used to power any machine or other device, including ships or other marine applications, locomotive applications, on-highway trucks or vehicles, off-highway machines, earth-moving equipment, generators, aerospace applications, pumps, stationary equipment such as power plants, or other engine-powered applications.

The internal combustion engine 10 comprises an engine block 20 including, in the exemplary embodiment shown in FIG. 1, four cylinders 26A to 26D, at least one fuel tank (not shown), a turbocharger 40 associated with the cylinders 26A to 26D, and an intake manifold 22. As shown in FIG. 1, the intake manifold 22 is fluidly connected to each of the cylinders 26A to 26D via a plurality of intake ducts 24A to 24D.

The engine block 20 includes a crankcase (not shown) within which a crankshaft (not explicitly shown) is supported. The crankshaft is connected to pistons that are movable within each of the cylinders 26A to 26D during operation of the internal combustion engine 10. Each of the cylinders 26A to 26D is provided with at least one inlet valve (not explicitly shown) that is adapted to open or close a fluid connection between the intake duct 24A to 24D and a corresponding combustion chamber of the cylinders 26A to 26D.

An exhaust manifold 28 is connected to each cylinder 26A to 26D. Each cylinder 26A to 26D is provided with at least one exhaust valve disposed in an exhaust duct 37A to 37D and being configured to open and close a fluid connection between the cylinders 26A to 26D and the exhaust manifold 28.

Generally, when the internal combustion engine 10 is operated, a mixture of gaseous fuel and air (in the following referred to as "combustion mixture") is introduced into the combustion chambers of the cylinders 26A to 26D. Specifically, a fuel system (not explicitly shown in the drawings) is configured to inject an appropriate amount of gaseous fuel into, for example, each intake duct 24A to 24D via, for example, a respective gaseous admission valve (not shown in the drawings) at a position upstream of the inlet valves.

Simultaneously, charged air is provided into each intake duct 24A to 24 D from the intake manifold 22. The gaseous fuel mixes with the charged air within each intake duct 24A to 24D and, subsequently, the combustion mixture is supplied to each cylinder 26A to 26D for combustion. After combustion of the combustion mixture, exhaust gas generated by the combustion process is released from the cylinders 26A to 26D through the exhaust ducts 37A to 37D into the exhaust manifold 28 and then into a main exhaust duct 29 connected to, for example, the turbocharger 40.

The turbocharger 40 is configured to use the heat and pressure of the exhaust gas of the internal combustion engine 10 to drive a compressor 44 for compressing intake air prior to being supplied to the engine. Specifically, exhaust gas passing a turbine 42 of the turbocharger 40 rotates the turbine 42, thereby decreasing in pressure and temperature. The compressor 44 is rotatably connected to the turbine 42 via a common shaft 46 and driven by the turbine 42.

Air is sucked in through an air inlet 4 and is supplied to the compressor 44. It should be appreciated that, in other embodiments relating to gaseous fuel internal combustion engines, gaseous fuel and air may be mixed in a mixer prior to be supplied to the compressor 44. It is also contemplated that gaseous fuel may be directly injected into each cylinder 26A to 26D using a suitable gaseous fuel injector.

Generally, an outlet of the compressor 44 is fluidly connected to an inlet of the intake manifold 22 via a compressor connection 21. As shown in FIG. 1, an outlet of the compressor 44 is connected to the inlet of the intake manifold 22 via a cooler 23. A throttle valve 27 arranged downstream of the cooler 23 is configured to open or close the fluid connection between the compressor connection 21 and the intake manifold 22, thereby enabling or restricting a flow from the compressor connection 21 into the intake manifold 22.

During operation of the internal combustion engine 10, intake air is compressed and cooled prior to being supplied to the cylinders 26A to 26D. Within the cylinders 26A to 26D, further compression and heating of the combustion mixture may be caused by movement of the pistons. Then, the combustion mixture within the cylinders 26A to 26D may be ignited, for example, by using a spark plug (not shown), or the combustion may be self-igniting by the compression within the cylinders 26A to 26D. The produced exhaust gas is discharged via the exhaust manifold 28.

An outlet of the exhaust manifold 28 is fluidly connected to an inlet of the turbine 42. An outlet of the turbine 42 may be fluidly connected to, for example, an exhaust gas treatment system (not shown).

In some embodiments, the internal combustion engine 10 may be provided with a wastegate system (not shown in the drawings) for controlling the rotational speed of the turbine 42 and the compressor 44 and/or a blow-off system (not shown in the drawings) for controlling the pressure of charged air within the intake manifold 22.

As further shown in FIG. 1, the internal combustion engine 10 comprises a starting air system 90 configured to provide pressurized starting air to the cylinders 26A to 26D during the starting mode of the internal combustion engine 10 in which the crankshaft is accelerated. The starting air system 90 includes a (for example separate) compressing device 80, a pressurized starting air source 91 connected to the compressing device 80 via a control valve 82, a starting air connection 92, a main starting valve 93 provided at the starting air connection 92, a starting air check valve 94 also provided at the starting air connection 92 downstream of the main starting valve 93, a starting air manifold 95, starting air ducts 96A to 96D, and cylinder starting valves 97A to 97B disposed in associated starting air ducts 96A to 96B. Moreover, the starting air system 90 comprises a starting air venting line 98, a starting air venting valve 99, and a sensing device 100.

The pressurized starting air source 91 may be sized and configured to store pressurized starting air sufficient for at least starting the internal combustion engine 10. The pressurized starting air may be stored under a predetermined pressure within the pressurized starting air source 91. As illustrated in FIG. 1, the pressurized starting air source 91 may be fluidly connected to the compressing device 80 via a control valve 82. For instance, after having accelerated and started the internal combustion engine 10, the pressurized starting air source 91 may be re-filled with pressurized air provided by the compressing device 80 for having sufficient pressurized starting air for a future starting process. Also, due to potential leakage of the pressurized starting air source 91, the pressurized starting air source 91 may be continuously re-filled when it is monitored that the pressure within the pressurized starting air source 91 is out of a predetermined range.

The compressing device 80 may suck in fresh air and may provide pressurized starting air under a predetermined pressure ranging from about 20 bar to about 60 bar, preferably from about 25 bar to 35 bar. In comparison, the compressor 44 may provide pressurized charged air to the intake manifold 22 under a pressure of, for example, about 2 bar to 8 bar.

The pressurized starting air source 91 is further fluidly connected to the starting air manifold 95 via the starting air connection 92. The main starting valve 93 and the starting air check valve 94 are provided at the starting air connection 92. Specifically, the main starting valve 93 may be controlled by, for instance, an engine control unit (not explicitly shown in the drawing) such that pressurized starting air may be allowed or disallowed from flowing from the pressurized starting air source 91 into the starting air manifold 95 depending on specific engine conditions, such as, for example, during a starting mode of the internal combustion engine 10. For preventing backflow from the starting air manifold 95 into the pressurized starting air source 91, the starting air check valve 94 is provided downstream of the main starting valve 93 for restricting such backflow of pressurized starting air.

After flowing into the starting air manifold 95, the pressurized starting air may flow into each starting air duct 96A to 96D associated with one of the cylinders 26A to 26D. The cylinder starting valves 97A to 97D are respectively associated with the starting air ducts 96A to 96D. The cylinder starting valves 97A to 97D may also be controlled by, for example, the engine control unit. Particularly, the cylinder starting valves 97A to 97D may allow a crankangle dependent flow of pressurized air into the associated cylinder 26A to 26D during the starting process of the internal combustion engine 10. When the internal combustion engine 10 runs independently on fuel, the cylinder starting valves 97A to 97D are closed.

Referring again to FIG. 1, the starting air venting line 98 is fluidly interconnected between the starting air manifold 95 and the starting air venting valve 99. The starting air venting valve 99 is configured to release the pressurized starting air left in the starting air manifold 95 after the internal combustion engine 10 has been started into the environment via a main venting device 110 and a venting (pipe) system (not explicitly shown in FIG. 1) located downstream of the main venting device 110. As indicated in FIG. 1, the main venting device 110 may also be configured to receive gaseous fluid vented from the crankcase of the internal combustion engine 10 via a crankcase venting line 60 fluidly connected to the crankcase. Preferably, the starting air venting valve 99 may be, for example, a solenoid venting valve configured to vent the pressurized starting air left in the closed volume of the starting air system 90 into the environment via the main venting device 110 and the venting system. The solenoid venting valve may also be controlled by, for example, the engine control unit.

The pressure within the starting air system 90 during the starting process may range from about 20 to about 60 bar, preferably from about 25 to 35 bar, whereas the pressure within the crankcase venting line 60 may range from about ambient pressure to a low overpressure ensuring that the crankcase may be vented.

The main venting device 110 may be further equipped with, for instance, a flame arrestor configured to choke any undesired flames generated in the main venting device 110, or a methane sensor configured to sense any methane present in the starting air venting line 98 and/or in the crankcase venting line 60.

The starting air system 90 further includes the sensing device 100 disposed, for example, in the vicinity of the starting air venting valve 99 for measuring the conditions within the closed volume of the starting air system 90. Preferably, the sensing device 100 is disposed at the starting air venting line 98. In some embodiments, the sensing device 100 may be disposed at the starting air venting line 98, the starting air manifold 95 and/or at one of the starting air ducts 96A to 96D.

The sensing device 100 may be generally a sensor configured to detect leakage through the cylinder starting valves 97A to 97D. The sensing device 100 may be, for instance, a pressure sensor configured to detect the pressure within the starting air venting line 98 or a methane or $CO_2$ sensor. In some embodiments, the sensing device 100 may be a temperature sensor configured to detect the temperature within the closed volume of the starting air system 90. The sensing device 100 may generate and transmit a signal indicative of the detected parameter within the starting air system 90 to the engine control unit.

As further shown in FIG. 1, a pressure relief valve 84 may be provided at the closed volume of the starting air system 90, preferably at the starting air venting line 98. The pressure relief valve 84 is configured, for example in emergency situations, to release at least some of the filling of the closed system into, for example, the engine bay when the pressure within the closed volume exceeds a predetermined pressure threshold, such as, for example, about 35 bar.

The engine control unit may be a single microprocessor or dual microprocessors that include means for controlling, among others, an operation of various components of the internal combustion engine 10. The control unit may be a general engine control unit (ECU) capable of controlling numerous functions associated with the internal combustion engine 10 and/or its associated components. The control unit may include all components required to run an application such as, for example, a memory, a secondary storage device, and a processor such as a central processing unit or any other means known in the art for controlling the internal combustion engine 10 and its components. Various other known circuits may be associated with the control unit, including power supply circuitry, signal conditioning circuitry, communication circuitry and other appropriate circuitry. The controller may analyze and compare received and stored data and, based on instructions and data stored in memory or input by a user, determine whether action is required. For example, the controller may compare received values with the target values stored in memory, and, based on the results of the comparison, transmit signals to one or more components to alter the operation status of the same.

INDUSTRIAL APPLICABILITY

In the following, operation of the internal combustion engine 10 is described in greater detail with reference to FIGS. 1 and 2. For instance, the internal combustion engine 10 is considered as a gaseous fuel internal combustion engine running on gaseous fuel, such as, for example, natural gas. However, the present disclosure is not limited to gaseous fuel internal combustion engines. For example, in some embodiments, the internal combustion engine 10 may be a dual fuel internal combustion engine or a liquid fuel internal combustion running on, for instance, diesel fuel or heavy fuel oil.

Figure 2:
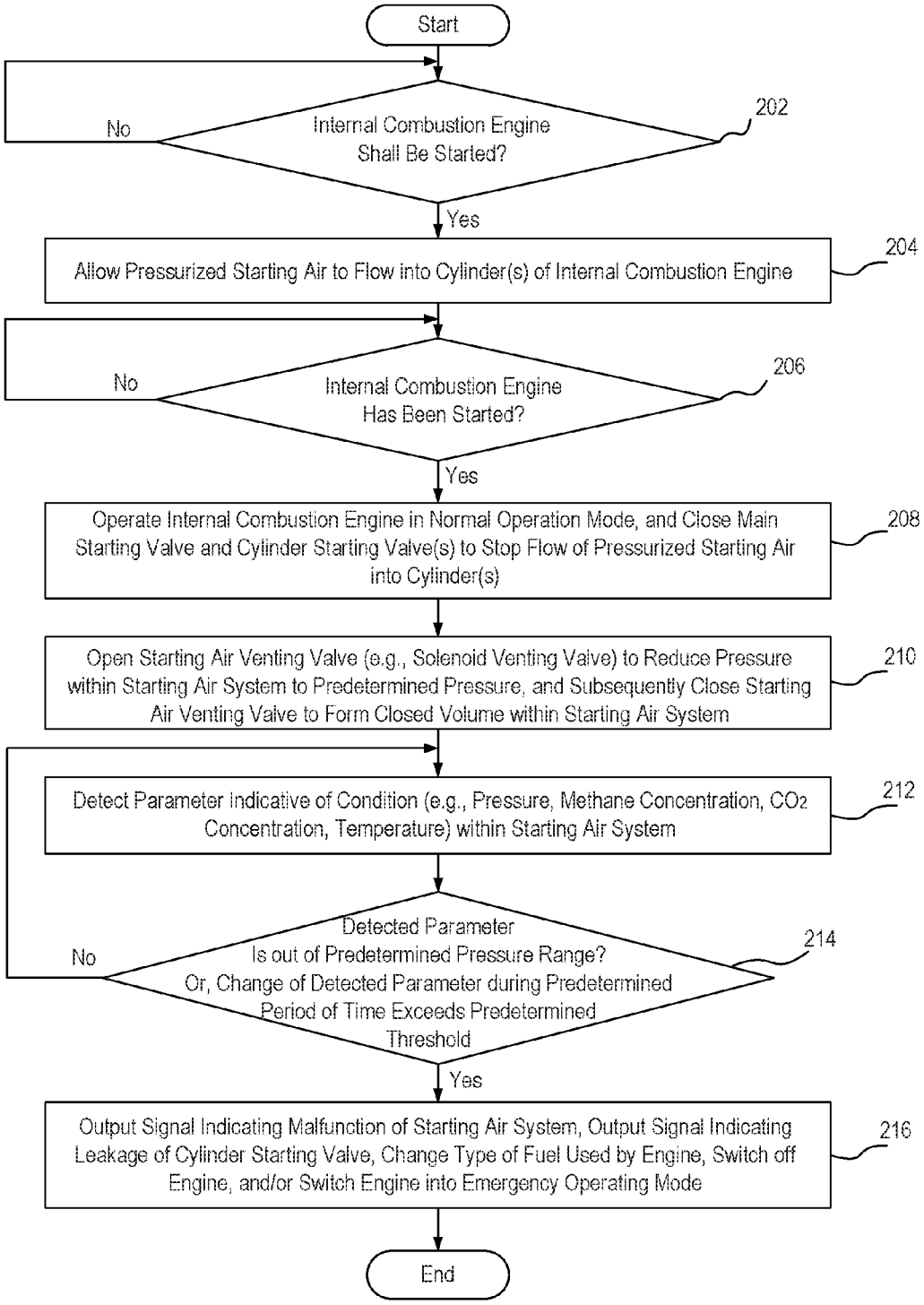
FIG. 2 is a flow chart of an exemplary method for operating the internal combustion engine.

FIG. 2 illustrates an exemplary method 200 for operating the internal combustion engine 10. At step 202, it is assessed whether the internal combustion engine 10 shall be started. As long as the internal combustion engine 10 shall not be started, the method 200 maintains at step 202. When it is determined that the internal combustion engine shall be started, the method 200 proceeds to step 204, where the internal combustion engine 10 is in the starting mode.

At step 204, the engine control unit controls the main starting valve 93 to open, thereby allowing pressurized gaseous fluid to flow from the pressurized starting air source 91 into the starting air manifold 95 and the starting air ducts 96A to 96D. Simultaneously, the engine control unit controls the respective cylinder starting valves 97A to 97D to open selectively. In such case, the pressurized starting air flows into the respective cylinders 26A to 26D in dependence of the crankangle thereby causing the pistons to move. During the starting mode, the starting air venting valve 99 maintains closed.

Subsequently, at step 206, it is assessed whether the internal combustion engine 10 is started or not. This assessment may be based on, for instance, at least one engine parameter indicative of the engine condition. For example, when the internal combustion engine 10 reaches a predetermined engine speed threshold, such as, for instance, the ignition engine speed that may be in a range from about 80 rpm to about 120 rpm, the internal combustion engine 10 may transition from the starting mode into the normal operation mode in which the internal combustion engine 10 is operating by supply of charged air via the intake manifold and gaseous fuel and/or liquid fuel. More precisely, the internal combustion engine 10 is in the starting mode as long the engine speed is below the predetermined engine speed, whereas the internal combustion engine 10 is in the normal operation mode when the engine speed is equal or greater than the predetermined engine speed threshold.

If, at step 206, it is determined that the engine speed is smaller than the predetermined engine speed threshold, the internal combustion engine 10 maintains in the starting mode and the method 200 maintains at step 206. However, if it is determined that the engine speed is equal or greater than the predetermined engine speed threshold, the internal combustion engine 10 transitions into the normal operation mode and the method 200 proceeds to step 208.

At step 208, the internal combustion engine 10 is already operating under normal conditions, which means by combusting the mixture of charged air and gaseous/liquid fuel within the combustion chambers of the cylinders 26A to 26D. The mixture of charged air and fuel provides a desired air-to-fuel ratio which complies a desired power output of the internal combustion engine.

The produced exhaust gas may be released out of the cylinders 26A to 26D via the associated exhaust valves and may then flow into the exhaust manifold 28 via the associated exhaust ducts 37A to 37D. Subsequently, the exhaust gas may drive the turbine 42 of the turbocharger 40, which in turn may drive the compressor 44 mechanically connected to the turbine 42 via the common shaft 46. The compressor 44 sucks in air and charges the air to a predetermined pressure, for example, about 2 to 8 bar. The charged air is provided to the intake manifold 22 via the throttle valve 27. The charged air is then distributed into each of the cylinders 26A to 26D via the intake ducts 24A to 26D.

Further, at step 208, the main starting valve 93 and the cylinder starting valves 97A to 97D are closed, such that supply of pressurized starting air to the at least one cylinder 26A to 26D is interrupted. Then, at step 210, the pressurized starting air left within the starting air manifold 95, the starting air ducts 96A to 96D and the starting air venting line 98 after closure of the main starting valve 93 and the cylinder starting air valves 97A to 97D is vented via the starting air venting valve 99, for example, into the environment. During the venting process, the pressure within the starting air system may be reduced to a predetermined pressure threshold, such as, for example, ambient pressure.

Then, the starting air venting valve 99 may be closed, such that the starting air system 90 is, due to the closed starting air check valve 94, the closed cylinder starting valves 97A to 97D, and the closed starting air venting valve 99, a closed (isolated) volume with, for instance, a substantially constant pressure therein. In the exemplary embodiment of FIG. 1, the closed volume is defined by the volume of the starting air manifold 95, the volume of the starting air ducts 96A to 96D upstream of the cylinder starting valves 97A to 97D, and the volume of the venting line 98 upstream of the starting air venting valve 99.

During the normal operation mode of the internal combustion engine 10, the main starting valve 93 and the cylinder starting valves 97A to 97D remain closed. Subsequently, at step 212, the sensing device 100 detects, for instance, the pressure within the starting air system 90, specifically within the starting air venting line 98.

At step 214, it is assessed, for example, whether the detected pressure within the starting air system 90 is out of a predetermined pressure range. For example, the predetermined pressure range may be in the range of about 10% around a predetermined pressure threshold. In some embodiments, the starting air system 90 may be vented to a predetermined pressure threshold, such as, for example, 2 bar. In such case, the pressure range may be a range of about 10%, preferably 5%, and more preferably 2% around the predetermined pressure threshold. The assessment of step 214 may be continuously or at constant or arbitrary time intervals.

For example, at step 214, it is assessed whether a temporal change of the detected pressure exceeds a predetermined threshold. For instance, the sensing device 100 may detect a temporal pressure change of the temporal filling within the closed volume. The temporal pressure change may be defined by a pressure change over a predetermined period of time.

At step 214, when it is assessed that the detected pressure is within the predetermined pressure range, the method 200 returns to step 212 for detecting the pressure within the starting air system 90 again. However, when it is assessed that the detected pressure is out of the predetermined pressure range, the method proceeds to step 216 where a signal indicative of, for example, a leakage of at least one of the cylinder starting valves 97A to 97D is output. In such case, the internal combustion engine 10 may be stopped due to the risk of leakage of the combustion mixture through the at least one leaking cylinder starting valve 97A to 97D into the starting air system 90 and, thus, into the engine's environment. This may also lead to an increase of the risk of potential explosions in the engine's environment.

In some embodiments, for example, when the evaluation is based on the temporal pressure change as described above, the method may proceed to step 216 when the temporal pressure change exceeds a predetermined pressure-time-relation-threshold. The pressure-time-relation-threshold may indicate a relation between the pressure change with respect to the period of time within the pressure change occurs. For instance, in case of a malfunction of at least one of the cylinder starting valves 97A to 97D, the pressure within the closed volume may rapidly increase to, for instance, 2 to 5 bar within a time of, for instance, about 5 to 10 combustion cycles. In some embodiments, due to at least some acceptable leakage through the cylinder starting valves 97A to 97D, there may be an expected drift of at least some fluid out of the cylinders 26A to 26D into the starting air system 90. However, when it is detected that the measured drift exceeds a predetermined threshold, a signal indicative of a malfunction of the starting air system 90 may be output.

In case of a dual fuel internal combustion engine, if the detected pressure is out of the predetermined pressure range during the gaseous fuel mode, the dual fuel internal combustion engine may be switched into the liquid fuel mode. Further, in case of a dual fuel internal combustion engine, if the detected pressure is out of the predetermined pressure range during the liquid fuel mode, the dual fuel internal combustion engine may be prevented from switching into the gaseous fuel mode.

The above described system and method for monitoring the functionality of the cylinder starting valves may also be employed in, for instance, internal combustion engines running on liquid fuel, such as diesel fuel, only and comprising a starting air system.

Although the preferred embodiments of this invention have been described herein, improvements and modifications may be incorporated without departing from the scope of the following claims.

The invention claimed is:

1. An internal combustion engine comprising:

a cylinder for combusting a mixture of fuel and air therein; and a starting air system configured to provide pressurized starting air to the cylinder, the starting air system comprising:

a pressurized starting air container configured to store pressurized starting air;

a starting air manifold fluidly connected to the pressurized starting air container;

a main starting valve interconnecting the pressurized starting air container and the starting air manifold, the main starting valve being configured to allow or disallow the pressurized starting air to flow from the pressurized starting air container into the starting air manifold;

a starting air check valve disposed downstream of the main starting valve and configured to prevent backflow of pressurized starting air from the starting air manifold into the pressurized starting air container;

a starting air venting valve fluidly connected to the starting air manifold and configured to vent the starting air system; and a sensor disposed downstream of the starting air check valve and upstream of the cylinder, the sensor being configured to detect a parameter indicative of a condition within the starting air system.

2. The internal combustion engine of claim 1, further comprising a controller communicatively coupled with the sensor, wherein the controller includes:

a memory storing instructions; and a processor configured to execute the instructions to:

determine whether the detected parameter is out of a predetermined parameter range; and when the detected parameter is determined to be out of the predetermined parameter range, perform at least one of:

outputting a signal indicating a malfunction of the starting air system has occurred;

changing a type of the fuel combusted by the cylinder;

switching off the internal combustion engine; and switching the internal combustion engine into an emergency operating mode.

3. The internal combustion engine of claim 1, wherein the sensor comprises at least one of:

a pressure sensor configured to measure a pressure within the starting air system;

a methane sensor configured to measure a methane concentration within the starting air system;

a $CO_2$ sensor configured to measure a $CO_2$ concentration within the starting air system; or a temperature sensor configured to detect a temperature within the starting air system.

4. The internal combustion engine of claim 1, wherein the starting air system further comprises a starting air venting line fluidly connecting the starting air manifold to the starting air venting valve.

5. The internal combustion engine of claim 1, wherein the starting air venting valve is a solenoid venting valve.

6. The internal combustion engine of claim 1, wherein the starting air venting valve is fluidly connected to a venting device, the venting device being configured to fluidly connect to a crankcase of the internal combustion engine and to vent the crankcase.

7. The internal combustion engine of claim 1, wherein the starting air system further comprises:

a starting air duct associated with the cylinder and configured to fluidly connect to the starting air manifold; and a cylinder starting valve disposed in the starting air duct.

8. The internal combustion engine of claim 1, further comprising a controller communicatively coupled with the sensor, wherein the controller includes:

a memory storing instructions; and a processor configured to execute the instructions to:

determine whether a change of the detected parameter during a predetermined period of time exceeds a predetermined threshold; and when the change of the detected parameter during the predetermined period of time is determined to exceed the predetermined threshold; perform at least one of:

outputting a signal indicating a malfunction of the starting air system has occurred;

changing a type of the fuel combusted by the cylinder;

switching off the internal combustion engine; and switching the internal combustion engine into an emergency operating mode.

9. A starting air system for providing pressurized starting air to an internal combustion engine, wherein the internal combustion engine comprises a cylinder for combusting a mixture of fuel and air therein, the starting air system comprising:

a pressurized starting air container configured to store pressurized starting air;

a starting air manifold fluidly connected to the pressurized starting air container;

a main starting valve interconnecting the pressurized starting air container and the starting air manifold, the main starting valve being configured to allow or disallow the pressurized starting air to flow from the pressurized starting air container into the starting air manifold;

a starting air check valve disposed downstream of the main starting valve and configured to prevent backflow of pressurized starting air from the starting air manifold into the pressurized starting air container;

a starting air venting valve fluidly connected to the starting air manifold and configured to vent the starting air system; and a sensor configured to detect a parameter indicative of a condition within the starting air system.

10. The starting air system of claim 9, further comprising a starting air venting line fluidly connecting the starting air manifold to the starting air venting valve.

11. The starting air system of claim 9, further comprising:

a starting air duct associated with the cylinder and configured to fluidly connect to the starting air manifold; and a cylinder starting valve disposed in the starting air duct.

12. A method for operating an internal combustion engine, wherein the internal combustion engine comprises a cylinder for combusting a mixture of fuel and air therein, and a starting air system configured to provide pressurized starting air to the cylinder and comprising: a pressurized starting air container storing pressurized starting air, a starting air manifold fluidly connected to the pressurized starting air container, a main starting valve interconnecting the pressurized starting air container and the starting air manifold, a starting air check valve disposed downstream of the main starting valve and configured to prevent backflow of pressurized starting air from the starting air manifold into the pressurized starting air container, a starting air venting valve fluidly connected to the starting air manifold and configured to vent the starting air system, a cylinder starting valve associated with the cylinder, a sensor disposed downstream of the starting air check valve and upstream of the cylinder starting valve, and a controller coupled with the main starting valve, the starting air venting valve, the cylinder starting valve, and the sensor, the method comprising:

after the internal combustion engine is started, closing, by the controller, the main starting valve, the starting air venting valve, and the cylinder starting valve to form a closed volume in the starting air system upstream of the cylinder starting valve;

detecting, by the sensor, a parameter indicative of a condition within the closed volume;

determining, by the controller, the detected parameter meets a predetermined criterion; and outputting, by the controller, a signal indicating leakage of the cylinder starting valve.

13. The method of claim 12, further comprising:

prior to detecting the parameter, opening, by the controller, the starting air venting valve to reduce a pressure in the closed volume to a predetermined pressure.

14. The method of claim 12, wherein detecting the parameter comprises:

detecting, by the sensor, at least one of a pressure, a methane concentration, a $CO_2$ concentration, or a temperature within the closed volume.

15. The method of claim 12, wherein determining the detected parameter meets the predetermined criterion comprises:

determining, by the controller, the detected parameter is out of a predetermined parameter range.

16. The method of claim 12, further comprising at least one of:

outputting, by the controller, a signal indicating the cylinder starting valve is not operating properly when the detected parameter is determined to meet the predetermined criterion;

operating, by the controller, the internal combustion engine to change a type of the fuel combusted by the cylinder when the detected parameter is determined to meet the predetermined criterion;

switching off, by the controller, the internal combustion engine when the detected parameter is determined to meet the predetermined criterion; or operating, by the controller, the internal combustion engine in an emergency operating mode when the detected parameter is determined to meet the predetermined criterion.

17. The method of claim 12, wherein determining the detected parameter meets the predetermined criterion comprises:

determining, by the controller, a change of the detected parameter during a predetermined period of time exceeds a predetermined threshold.

* * * * *